US007798829B2

(12) United States Patent
Fong

(10) Patent No.: US 7,798,829 B2
(45) Date of Patent: Sep. 21, 2010

(54) BASIC INSULATING PLUG AND METHOD OF MANUFACTURE

(75) Inventor: Robert Fong, Bethlehem, PA (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 12/402,775

(22) Filed: Mar. 12, 2009

(65) Prior Publication Data

US 2009/0258517 A1 Oct. 15, 2009

Related U.S. Application Data

(60) Provisional application No. 61/044,076, filed on Apr. 11, 2008.

(51) Int. Cl.
*H01R 13/44* (2006.01)

(52) U.S. Cl. ..... 439/148

(58) Field of Classification Search ..... 439/148, 439/921, 186, 607

See application file for complete search history.

(56) References Cited

U.S. PATENT DOCUMENTS

| | | | | |
|---|---|---|---|---|
| 1,998,129 | A | 4/1935 | Fullman | |
| 2,428,323 | A | 9/1947 | Winer | |
| 3,585,568 | A | 6/1971 | Hervig et al. | |
| 3,740,700 | A | 6/1973 | Robertson | |
| 3,883,208 | A | 5/1975 | Sankey et al. | |
| 3,980,374 | A * | 9/1976 | Fallot | 439/89 |
| 4,258,970 | A | 3/1981 | Bourdon et al. | |
| 4,477,376 | A | 10/1984 | Gold | |
| 4,740,169 | A | 4/1988 | Gordon | |
| 4,764,123 | A * | 8/1988 | Shaw et al. | 439/148 |
| 4,865,559 | A | 9/1989 | Clabburn | |
| 4,875,952 | A | 10/1989 | Mullin et al. | |
| 5,589,666 | A | 12/1996 | DeCarlo et al. | |
| 5,802,715 | A | 9/1998 | O'Neill | |
| 6,227,908 | B1 * | 5/2001 | Aumeier et al. | 439/607.01 |
| 6,309,246 | B1 | 10/2001 | Keaton et al. | |
| 6,332,785 | B1 | 12/2001 | Muench, Jr. et al. | |
| 6,939,151 | B2 | 9/2005 | Borgstrom et al. | |
| 7,217,146 | B2 | 5/2007 | Meister et al. | |

(Continued)

FOREIGN PATENT DOCUMENTS

| | | |
|---|---|---|
| EP | 0854545 | 7/1998 |

(Continued)

OTHER PUBLICATIONS

Cooper Power Systems, Electrical Apparatus 550-30; 630 A Deadbreak Bolted Tee Connector, Feb. 2007, p. 1-4.

(Continued)

*Primary Examiner*—Phuong K Dinh
(74) *Attorney, Agent, or Firm*—Hoffman & Baron, LLP

(57) ABSTRACT

A basic insulating plug (BIP) provides connection to a dead-break connector. The basic insulating plug includes a first conductive insert and a second conductive insert. An insulative coupling supports the inserts in spaced apart position. An insulative body is molded substantially about the first and second conductive inserts. One of the conductive inserts and the insulative coupling define a flow path to permit flow of insulative material entering one of the conductive inserts to flow through the coupling so as to surround the coupling and substantially surround the first and second inserts.

10 Claims, 2 Drawing Sheets

U.S. PATENT DOCUMENTS

| | | | |
|---|---|---|---|
| 7,287,992 | B2 | 10/2007 | Chawgo |
| 2007/0141882 | A1 | 6/2007 | Stepniak |

FOREIGN PATENT DOCUMENTS

| | | |
|---|---|---|
| WO | WO 90/11631 | 10/1990 |

OTHER PUBLICATIONS

600-Amp Basic Insulating Plug, Indoor Application Cycloaliphatic Epoxy, Reuel, Inc., Data Sheet DSBIP-01, May 2, 2007.

Cable Accessories, Elastimold-Thomas & Betts Corporation, PG-CA-0307, p. 10-17; 28-28-29; 32-39.

* cited by examiner

BASIC INSULATING PLUG AND METHOD OF MANUFACTURE

CROSS-REFERENCE TO RELATED APPLICATION

This application claims priority to U.S. Provisional Patent Application No. 61/044,076 on Apr. 11, 2008, herein incorporated by reference.

FIELD OF THE INVENTION

The present invention relates generally to a basic insulating plug (BIP) for connection to a deadbreak connector. More particularly, the present invention relates to a method of manufacturing such a basic insulating plug.

BACKGROUND OF THE INVENTION

Connections in underground power distribution systems, such as between cables and transformers, are generally accomplished with specifically designed separable male and female electrical connectors. One type of such connector is a deadbreak connector which has a generally T-shaped configuration having a cable terminated to the main portion of the T configuration and having connection capability to one of the two branches of the T configuration.

Quite often, it is desirable to perform ancillary functions on the connector and cable system without having to de-energize the system. Such functions include active voltage sensing for certain control and voltage surge arresting for lightening protection. In such situations, an interface is provided to allow electrical access to the system. Such interface is typically provided at the opposite one of the branches of the T configuration.

In order to close the interface when the ancillary functions are not being performed, a basic insulating plug (BIP) is employed. The plug is a separable connector component which is insertable into the interface of the existing deadbreak connector. The plug provides a dead-end which terminates the access point preventing direct access to the conductor.

Typical plugs of this type include an insulative body having at one end an electrically conductive internally threaded insert for attachment to the threaded stud in the interface of the deadbreak connector. The insulative body also supports a top hex shaped insert which allows the plug to be connected in the deadbreak interface and torqued to a specified value.

While these plugs serve adequately for their intended purpose, manufacturing such plugs is time consuming and costly and limits manufacturing capacity and multiple operation, inasmuch as the body is typically formed from an epoxy material having a long curing time.

It is desirable to provide a more efficient manufacturing process and resulting plug structure.

SUMMARY OF THE INVENTION

The present invention provides a basic insulating plug for closing an electrical interface in a deadbreak connector. This plug includes a first conductive insert and a second conductive insert. An insulative coupling supports the inserts in spaced apart relationship. An insulative body is molded substantially around the coupling and the first and second conductive inserts. One of the conductive inserts and insulative coupling defines a flow path to permit flow of an insulative material, entering one of the conductive inserts, through the coupling so as to surround the coupling and substantially surround the first and second conductive inserts to thereby form the elastomeric body therearound.

In a method aspect of the present invention, a method of forming a basic insulating plug is provided. The method includes providing a first conductive insert having a flow path therethrough. A second conductive insert is also provided. An annular coupling is provided having a sidewall and opposed open ends where the sidewall includes at least one opening therethrough. The first and second conductive inserts are attached to the open ends of the coupling so as to establish a flow path from the first conductive insert through the coupling. The annular coupling with the conductive inserts attached thereto is placed in a mold. An insulative material is injected into the first conductive insert and through the flow path to fill the mold about the coupling and the conductive inserts.

DETAILED DESCRIPTION OF THE PREFERRED EMBODIMENT

Figure 1:
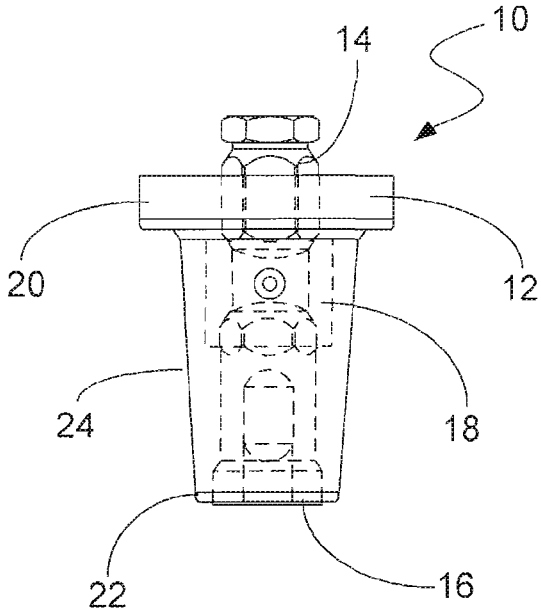
FIGS. 1 and 2 are side and top plan views, respectively, of the basic insulating plug of the present invention.
Figure 2:
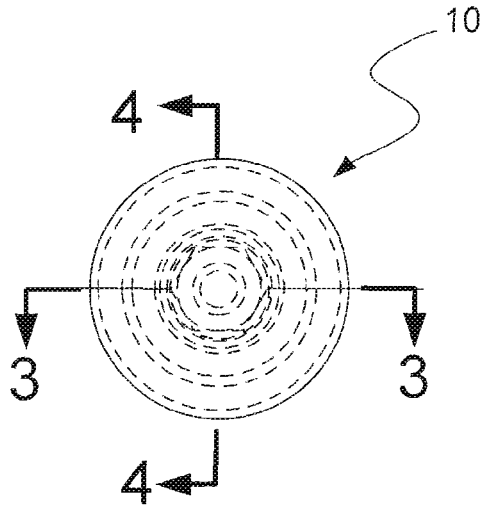
Figure 3:
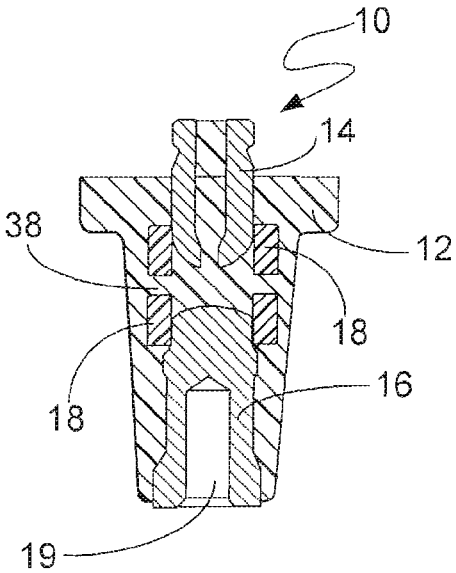
FIGS. 3 and 4 are vertical cross sections of the plug of FIGS. 1 and 2 taken through the lines 3-3 and 4-4, respectively, of FIG. 2.
Figure 4:
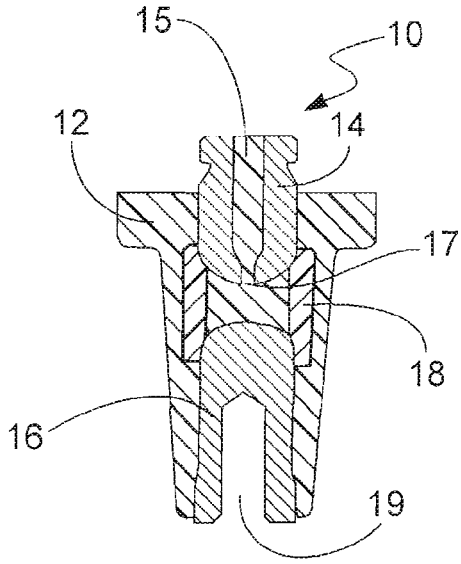

The present invention provides a basic insulating plug or BIP (hereinafter "plug") for use in combination with a deadbreak connector (not shown). Referring to FIGS. 1-4, plug 10 of the present invention includes an insulative body 12, a first conductive insert 14, a second conductive insert 16, and insulative coupling 18 supporting inserts 14 and 16 in spaced apart relationship within body 12.

Body 12 is designed for insertion into an interface in a deadbreak connector. As is well known in the art, the interface of the deadbreak connector may be used to perform ancillary functions on the connector and cable of the system without having to de-energize the system. Thus, the particular shape of the body 12 is designed to provide sealed engagement with the interface of the deadbreak connector.

Body 12 has opposed ends 20 and 22 and a generally tapered elongate extent 24 which is designed for coupling to the deadbreak interface.

Body 12 is formed of an insulating material such as, for example, a molded elastomer which is a rapidly curing rubber-like material which, as will be described hereinbelow, provides manufacturing expediencies. In many existing plugs, the body is formed from a solid block of epoxy which has an extended curing time. This greatly increases the cost of manufacturing the plug.

Figure 5:
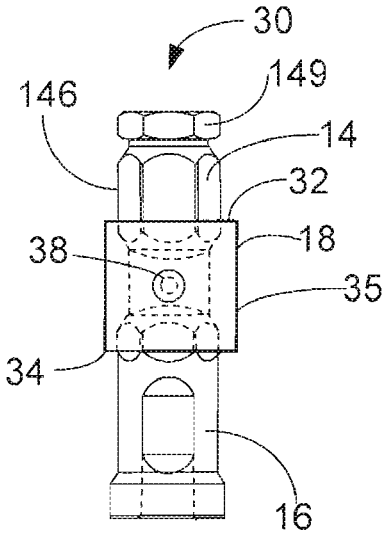
FIG. 5 is a plan view of a subassembly of conductive inserts and an insulative coupling of the plug of FIG. 1.
Figure 6:
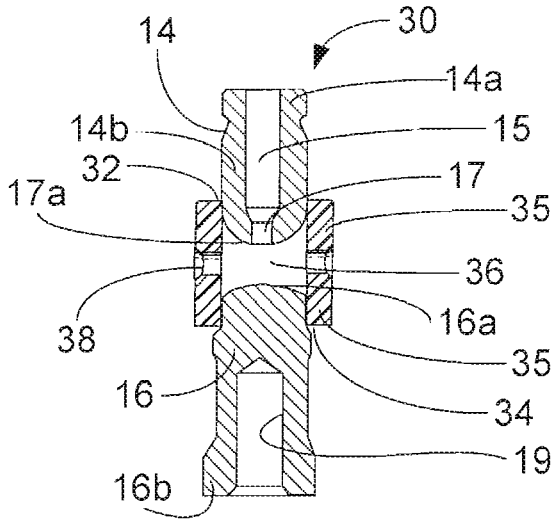
FIG. 6 is a vertical sectional showing of the subassembly of FIG. 5.

Supported within body 12 is a connection subassembly 30, shown additionally in FIGS. 5 and 6. Subassembly 30 includes first conductive insert 14, second conductive insert 16 and an insulative coupling 18 supporting the conductive inserts 14 and 16 in spaced apart relationship.

Conductive insert 14 is generally of conventional construction having a hex head 14*a* and an elongate hex body 14*b*. As particularly shown in FIG. 6, conductive insert 14 is generally a hollow member having a passageway 15 extending therethrough. Conductive insert 14 also includes am opening 17 formed through the lower end 17*a* thereof which is in flow communication with passageway 15. The conductive insert 14 is formed of an electrically conductive high strength material such as copper or aluminum.

Conductive insert 16, which may also be formed of a high strength conductive material such as copper or aluminum, includes an upper portion 16*a* and a lower portion 16*b* having an elongate internally threaded aperture 19 therein. Threaded aperture 19 is conventional in construction and allows the plug 10 to be threadably attached to the interface of the deadbreak connector.

Coupling 18 serves to support inserts 14 and 16 in spaced apart relationship in subassembly 30. Coupling 18 is generally a tubular member including an annular sidewall 35 defining opposed open ends 32 and 34. Coupling 18 further defines an interior cavity 36 and generally a plurality of openings 38 through the sidewall 35 thereof. The coupling 18, which is formed of a suitable insulative material in order to electrically isolate inserts 14 and 16, supports the inserts at the opposed open ends 32 and 34 in spaced apart relationship. Moreover, the coupling 18 supports the inserts 14 and 16 in a manner such that the torque applied to the first conductive insert 14 is directly transmitted to the second conductive insert 16. The arrangement of the inserts and the coupling, particularly as shown in FIG. 6, defines a space within the interior cavity 36 between inserts 14 and 16.

The configuration of coupling 18, including the interior cavity 36 and openings 38 together with the passageway 15 and opening 17 of insert 14, define a flow passage through coupling 14 and out through openings 38 of sidewall 35 of coupling 18. As will be described in detail hereinbelow, this flow path allows body 12 to be molded about subassembly 30.

Figure 7:
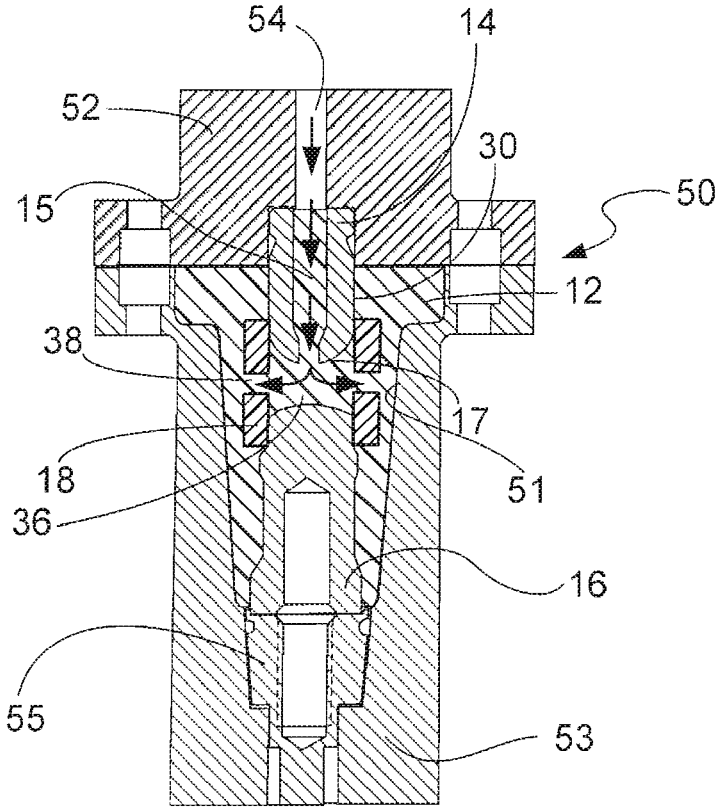
FIG. 7 shows, in section, the subassembly of FIG. 5 supported within a mold for forming an insulative body thereabout.

Referring now to FIG. 7, the formation of plug 10 of the present invention may now be described. The subassembly 30, including coupling 18 and inserts 14 and 16 shown as arranged in FIGS. 5 and 6, is placed in a mold 50 of a conventional injection molding machine (not shown). The mold 50 includes mold components which define a mold cavity 51 having the shape and configuration necessary to form body 12 about subassembly 30. The mold components include an upper mold component 52 and lower mold components 53 and 55. The upper mold component 52 includes an injection port 54 which is in communication with passageway 15 of insert 14. The injection port 54 is used to inject the insulative material into cavity 51 using the flow path established through subassembly 30.

As shown by the arrows in FIG. 7, the insulative material may be injected through port 54 to extend through passageway 15 and out through opening 17 of insert 14. Thereafter, the injected insulative material fills cavity 36 and exits through openings 38 of sidewall 35 to fill the mold cavity 51 forming body 12. As the insulative material used to form body 12 may be a quick curing rubber-like elastomer, the cycle time for forming plug 10 is greatly reduced. This increases the efficiency of the manufacturing process and decreases the manufactured cost of the plug.

While the invention has been described in related to the preferred embodiments with several examples, it will be understood by those skilled in the art that various changes may be made without deviating from the fundamental nature and scope of the invention as defined in the appended claims.

What is claimed:

1. A basic insulating plug (BIP) for closing an electrical interface in a deadbreak connector comprising:

a first conductive insert;

a second conductive insert;

an insulated coupling supporting said inserts in a spaced apart position;

an insulative body molded substantially about said first and second conductive inserts;

one of said conductive inserts and said insulative coupling defining a flow path to permit flow of insulative material entering said one of conductive insert to flow through said coupling so as to surround said coupling and substantially surround said first and second inserts.

2. A basic insulating plug of claim 1 wherein said first and second conductive inserts are elongate members having opposed ends to effect connection of said plug to said electrical interface.

3. A basic insulating plug of claim 2 wherein said insulative coupling includes an annular body having a first end for insertably accommodating said first conductive insert and a second end for accommodating said second conductive insert and defining a cavity therebetween.

4. A basic insulating plug of claim 3 wherein said insulative coupling includes at least one opening thereby defining said flow path.

5. A basic insulating plug of claim 4 wherein said one conductive insert has an opening in flow communication with said opening in said coupling for further defining said flow path.

6. A basic insulating plug of claim 1 wherein said insulative material is an elastomer.

7. A basic insulating plug comprising:

a connection subassembly; and an body of insulative material molded about said connection subassembly wherein said connection subassembly includes:

a first conductive insert having a passageway therethrough;

a second conductive insert; and an insulative annular coupling having opposed open ends and a sidewall having at least one opening therethrough;

said coupling supporting said first and second inserts at said opposed open ends in spaced apart relationship, and defining a flow path from said passageway of said first insert and through said at least one opening in said sidewall for permitting flow of said insulative material therethrough to form said body about said subassembly.

8. A basic insulating plug of claim 7 wherein said first conduit insert is a hollow member.

9. A basic insulating plug of claim 7 wherein said first and second conduit inserts are formed of conductive materials selected from the group consisting of copper and aluminum and combinations thereof.

10. A basic insulating plug of claim 7 wherein said coupling supports said first and second inserts in electrical isolation.

* * * * *